US005950478A

United States Patent [19]

Sato et al.

[11] Patent Number: 5,950,478

[45] Date of Patent: Sep. 14, 1999

[54] HOT TANDEM ROLLING MILL

[75] Inventors: Masayoshi Sato, Hiratsuka; Kazuyuki Sato; Hisashi Honjou, both of Yokohama; Masahiro Kuchi, Chigasaki, all of Japan

[73] Assignee: Ishikawajima-Harima Heavy Industries Co., Ltd., Tokyo, Japan

[21] Appl. No.: 09/084,205

[22] Filed: May 26, 1998

[30] Foreign Application Priority Data

May 29, 1997 [JP] Japan ..... 9-139626

[51] Int. Cl.[6] ..... B21B 31/18; B21B 37/16

[52] U.S. Cl. ..... 72/247; 72/9.1; 72/11.7

[58] Field of Search ..... 72/234, 241.2, 72/241.4, 243.2, 243.4, 243.6, 245, 247, 9.1, 11.7, 11.8, 9.2

[56] References Cited

U.S. PATENT DOCUMENTS 4,864,836 9/1989 Ochiai ..... 72/247
5,174,144 12/1992 Kajiwara et al. ..... 72/241.2
5,640,866 6/1997 Satoh et al. .
5,655,398 8/1997 Ginzburg ..... 72/241.4

*Primary Examiner*—Rodney Butler
*Attorney, Agent, or Firm*—Griffin, Butler, Whisenhunt & Szipl, LLP

[57] ABSTRACT

There are provided an even number of paired roll-shift type rolling mills 12*a*, 12*b* and a controller 16 for controlling the rolling mills 12*a*, 12*b*. Each of upper and lower work rolls 13 of each of the roll-shift type rolling mills has a predetermined crown curve and has a roll shifting mechanism 14 for axially shifting the upper and lower work rolls relative to each other. The controller 16 determines a shift amount of each rolling mill in order to obtain a predetermined cross section shape of a steel plate, shifts the work rolls of the rolling mill on the upstream side paired every rolling coil to thereby disperse wear on the roll surface, and moves the work rolls of the rolling mill on the downstream side of the pair in a predetermined direction by the same distance, thereby canceling the change in the cross section shape of the plate caused by the shifting operation for the wear dispersion.

6 Claims, 4 Drawing Sheets

Odd-number stand

Even-number stand

Odd-number stand

Even-number stand

HOT TANDEM ROLLING MILL

BACKGROUND OF THE INVENTION

1. Field of the Invention

The present invention relates to a hot tandem rolling mill which can perform both shape control by shifting rolls and wear dispersion.

2. Related Background Art

A roll-shift type rolling mill schematically shown in FIG. 1 (for example, U.S. Pat. No. 5,640,866, Japanese Patent Laid-Open No. 7-232202, and the like) is known as a roll mill used to obtain a very flat plate product. According to the roll-shift type rolling mill, upper and lower work rolls 1 having convex and concave parts as shown in U.S. Pat. No. 5,640,866 are alternately shifted in the axial direction of the rolls, and roll a plate member 2, thereby controlling the shape in cross section of the plate member.

On the other hand, in an ordinary hot finishing rolling mill, a rolling part of the surface of a roll is worn as the number of plates which are rolled increases. Especially, the end parts of the roll are worn more than the center part. When a plate to be rolled next is wide, the cross section of the plate has a shape in which the both ends are thicker (those are called cat's ears) as schematically shown in FIG. 2 and the rolled shape deteriorates.

In a conventional hot finishing rolling mill, therefore, the width of a plate cannot be freely changed and rolling operation is performed according to a predetermined operation schedule (called a coffin schedule) as shown in an example of FIG. 3. According to the example of FIG. 3, the axis of abscissa denotes the number of rolling coils after roll replacement and the axis of ordinate shows the rolling width of plates. In order to obtain a necessary plate width, rolling operation for narrow plates is repeated and the rolls are warmed, and plate members are rolled in accordance with the order of the wider plate members. Other various operation schedules are used according to hot finishing rolling lines.

In the conventional hot finishing rolling mill, as mentioned above, since the rolling operation is performed according to a predetermined operation schedule, there is a problem that schedule-free rolling operation which is performed irrespective of the plate width cannot be executed.

Consequently, there has been proposed that the upper and lower work rolls are axially shifted relative to each other by using the above-mentioned roll-shift type rolling mill, thereby dispersing local wear of the surface of the roll and achieving the schedule-free rolling operation. In this case, however, since a shifting function is used to disperse the wear of the surface of the roll, there is a problem that an inherent control of the cross section shape cannot be performed.

That is, hitherto, the function of shifting the upper and lower work rolls of the roll-shift type rolling mill in the axial direction is used to control the cross section shape of a steel plate. The shifting function is, however, used for dispersing the wear of the roll, so that the shape cannot be controlled. There is consequently a problem that the wear dispersion and the cross section shape control are incompatible.

SUMMARY OF THE INVENTION

The present invention is provided in order to solve the problems. Therefore it is an object of the present invention to provide a hot tandem rolling mill which can realize both of schedule-free rolling operation by dispersing wear of the surface of the roll and a control of a cross section shape of a steel plate.

According to the present invention, there is provided a hot tandem rolling mill having roll-shift type rolling mills of an even number which are paired and a controller for controlling the rolling mills. Each of upper and lower work rolls of each of the roll-shift type rolling mills has a predetermined crown curve. There is also provided a roll shifting mechanism for axially moving the upper and lower work rolls relative to each other. The controller determines a shift amount of each rolling mill in order to obtain a predetermined cross section shape of a steel plate, shifts the work rolls of the rolling mill on the upstream side of a pair by a predetermined amount by using the shift position as a center for every rolling coil to thereby disperse wear of the surface of the roll, and moves the work rolls of the rolling mill on the downstream side of the pair in a predetermined direction by the same distance, thereby canceling the change in the cross section shape of the plate caused by the shifting operation for the wear dispersion.

According to the construction of the present invention, since rolling operation is performed by axially shifting the work rolls of the roll-shift type rolling mills of an even number which are paired by using the shift position determined to obtain a predetermined plate crown for every rolling coil, the wear of the surface of each roll can be dispersed. Further, by performing the rolling operation of the rolling mills on the upstream and downstream sides in a predetermined direction (for example, opposite directions or the same direction) by the same distance, the change in the cross section shape of the steel plate caused by the shifting operation to disperse wear occurring in the rolling mill on the upstream side can be canceled by the rolling mill on the downstream side. Since the plate crown is controlled by changing the center position of reciprocating shift for wear dispersion, the achievement of the schedule-free rolling operation and the control of the cross section shape of the steel plate, that is, the plate crown control by the dispersion of the local wear of the roll surface can be compatibly performed.

The other objects and advantageous features of the present invention will become apparent from the following detailed description with reference to the appended drawings.

DESCRIPTION OF THE PREFERRED EMBODIMENTS

Figure 1:
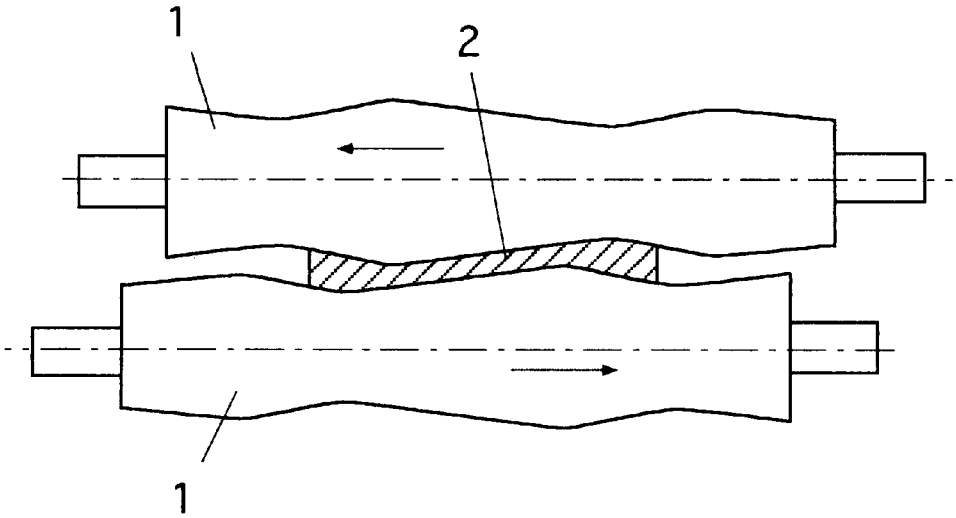
Fig. 1 Prior Art
FIG. 1 is a schematic diagram showing a conventional roll-shift type rolling mill.
Figure 2:
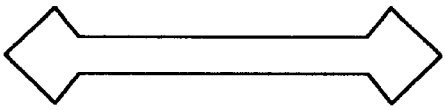
Fig. 2 Prior Art
FIG. 2 shows an example of a cross section shape of a plate due to wear of rolls.
Figure 3:
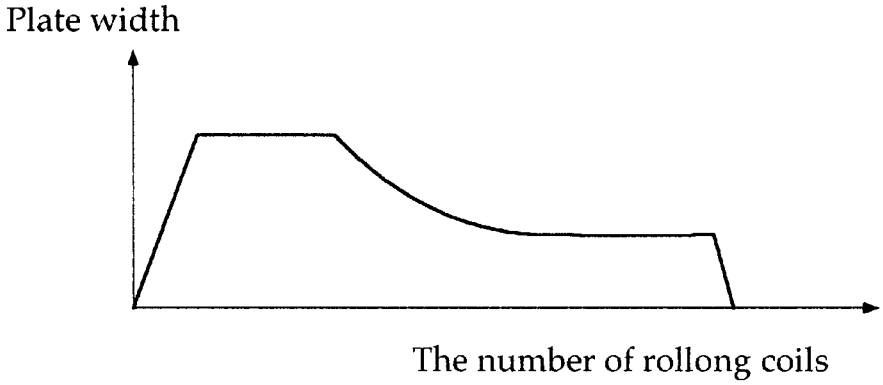
Fig. 3 Prior Art
FIG. 3 shows an example of operating schedule in a conventional hot tandem rolling mill.

Embodiments of the present invention will be described hereinbelow with reference to the drawings. Common portions in the drawings are designated by the same reference numerals and repetition of the description is omitted.

Figure 4:
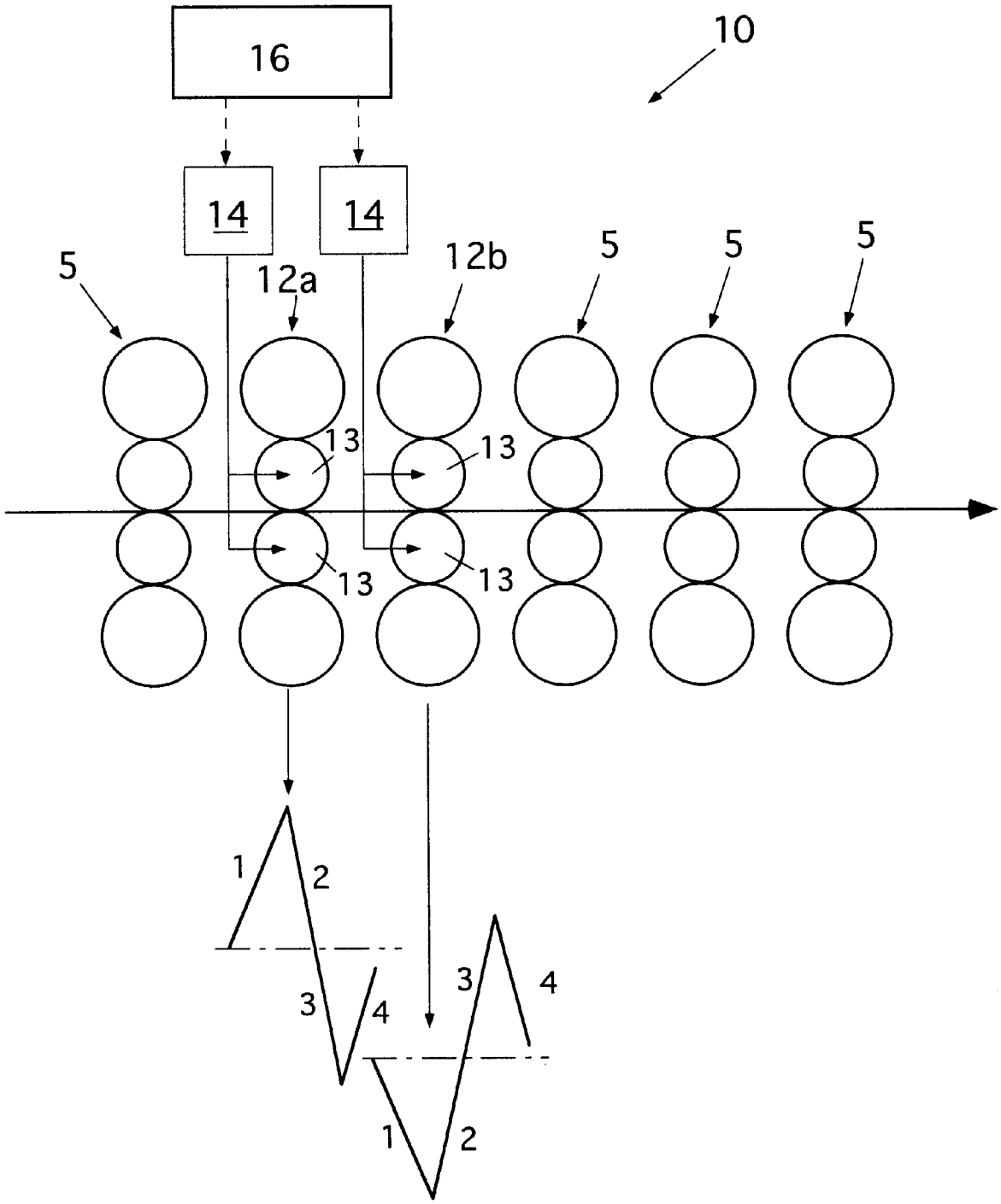
FIG. 4 is a diagram showing the whole construction of a hot tandem rolling mill according to the present invention.

FIG. 4 is a diagram illustrating the whole construction of a hot tandem rolling mill of the present invention. In the diagram, a hot tandem rolling mill 10 of the invention has an even number of roll-shift type rolling mills 12*a*, 12*b* which are paired (one pair is used in the diagram) and a controller 16 for controlling the rolling mills. In the diagram, other rolling mills 5 are regular ones which are not of the roll-shift type (for example, they are four-stage rolling mills). The whole rolling mills 5 perform tandem rolling operation to thereby obtain a predetermined percentage reduction in thickness. The present invention is not limited that the roll-shift type rolling mills 12*a*, 12*b* are paired. Roll-shifting type rolling mills of four or larger even-number can be also used. Although it is preferable to arrange the pair of the rolling mills so as to be neighboring each other as shown in the diagram, the present invention is not limited to the arrangement. A rolling mill of a different type may be also interposed between the roll-shift type rolling mills 12 on the upstream side and the downstream side.

Each of the upper and lower work rolls 13 of each of the roll-shift type rolling mills 12*a*, 12*b* has a predetermined crown curve for controlling the cross section shape of a plate. The rolling mill 12 has a roll-shifting mechanism 14 for axially shifting the upper and lower work rolls 13 relative to each other.

The controller 16 determines a shift amount of each of the rolling mills 12*a*, 12*b* in order to obtain a predetermined cross section shape of a steel plate and shifts the work rolls 13 of the rolling mill 12*a* on the upstream side of each pair every rolling coil by using the shift position as a center, thereby dispersing the wear on the roll surface. The controller 16 shifts the work rolls 13 of the rolling mill 12*b* on the downstream side of the pair in a predetermined direction (opposite or same direction) by the same distance correspond to the shift stroke of the rolling mill 12*a*, thereby canceling the change in the cross section shape of the plate by the shift for the wear dispersion. The roll-shifting mechanism 14 axially shifts the upper and lower work rolls 13 relative to each other in accordance with a control signal from the controller 16.

Figure 5:
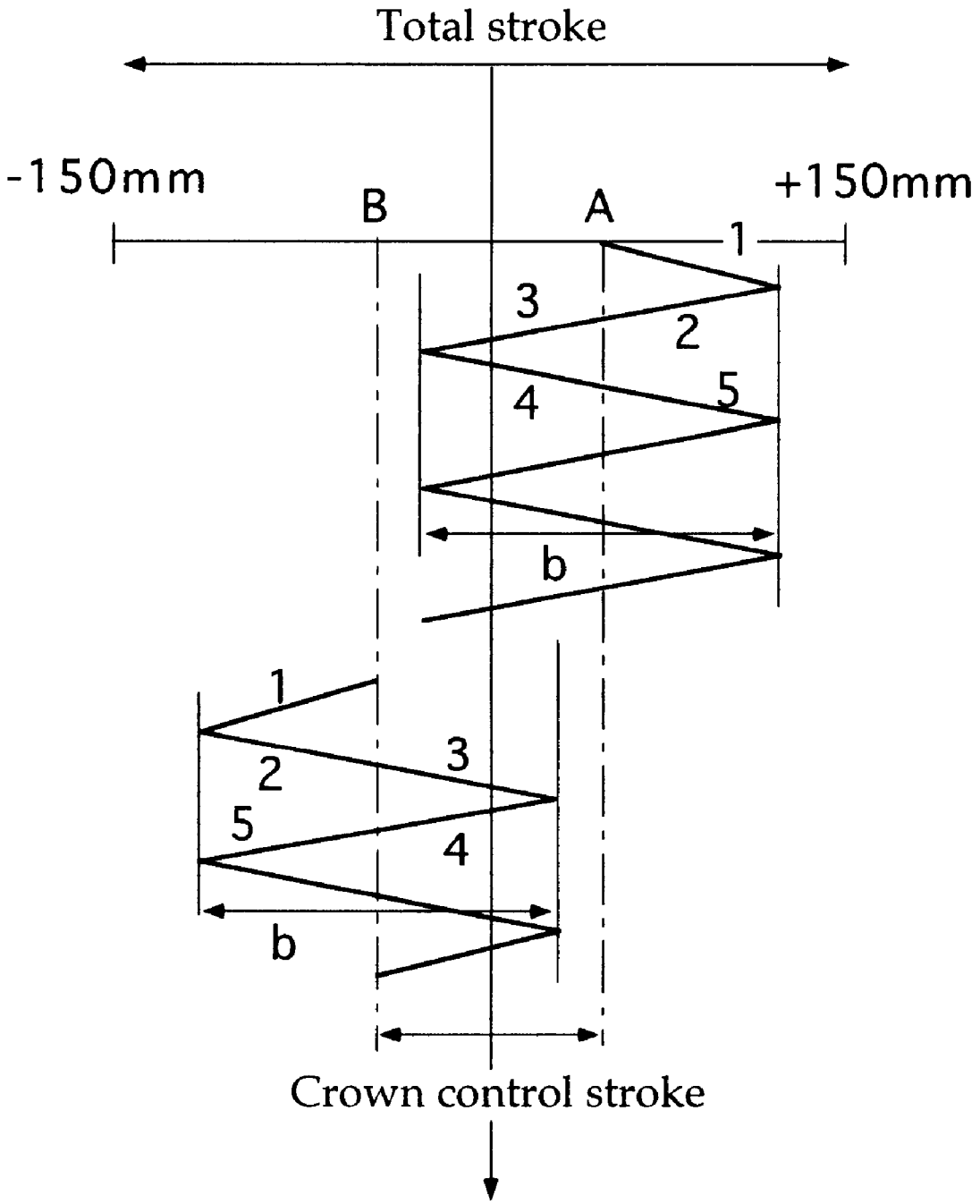
FIG. 5 is a diagram explaining the principle of the present invention.
Figure 6A:
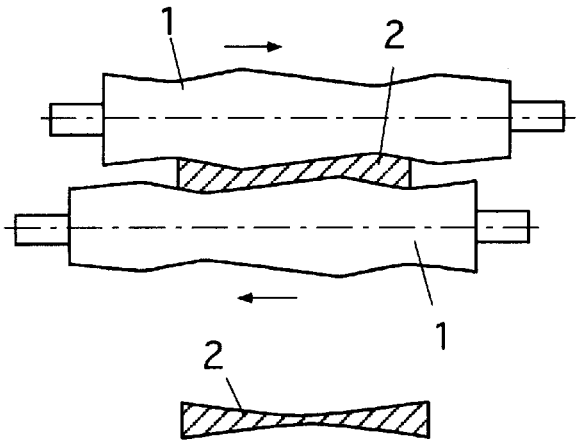
FIG. 6A is a diagram showing a roll shift state of an odd-number stand according to the present invention.
Figure 6B:
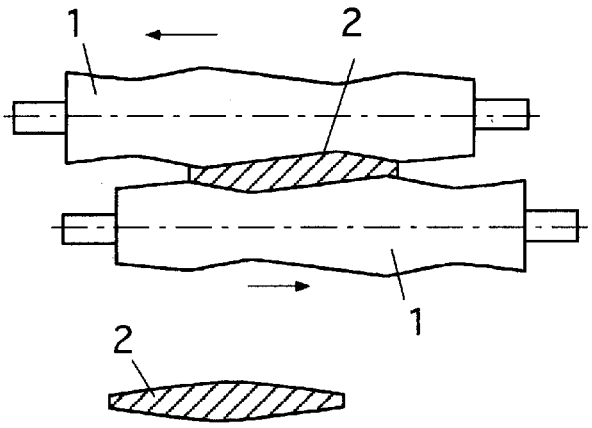
FIG. 6B is a diagram showing a roll shift state of an even-number stand according to the present invention.

FIG. 5 is a diagram explaining the principle of the present invention. FIG. 6 is a diagram showing a roll-shifting state of the present invention in this case. In FIG. 5, the axis of abscissa denotes the shift amount and the center is zero. The axis of ordinate shows the shifting amount of the roll-shift type rolling mills 12*a*, 12*b*. Corresponding rolling operations are shown by the same numbers (1, 2, 3, . . . ) in the diagram.

According to the example, the shift amounts of the rolling mills 12*a*, 12*b* determined by the controller 16 are, for example, +30 mm and −30 mm, respectively, although it is not necessary that the shift amounts are equal. A shifting amount (oscillation amount) b in the axial direction for wear dispersion is set to, for example, ±75 mm. Further, the rolling mills 12*b* and 12*a* have the opposite shifting directions (oscillation directions) for wear dispersion. That is, in the hot tandem rolling mill 10, while oscillating within a range of ±150 mm, the plate crown control is performed by varying the oscillation center values A, B.

According to the above-mentioned construction of the invention, rolling operation is performed while axially shifting the work rolls 13 of the roll-shift type rolling mills 12*a*, 12*b* of an even number which are paired every coil by using the shift positions A, B determined in order to obtain a predetermined plate crown, so that the wear of the surface of the roll can be dispersed. Further, in case of the odd-number stand and the even-number stand shown in FIG. 6, by shifting the rolling mills on the upstream and downstream sides in the opposite directions by the same distance, the change in the cross section shape of the steel plate caused by the shifting operation for dispersing the wear occurring in the rolling mill 12*a* on the upstream side can be canceled by the rolling mill 12*b* on the downstream side. The achievement of the schedule-free rolling operation and the control of the cross section shape of the steel plate, that is, the plate crown control by the dispersion of the local wear of the roll surface can be compatibly performed.

Figure 7A:
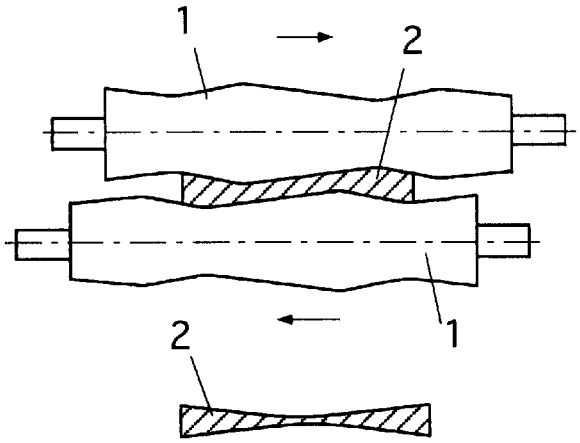
FIG. 7A is another diagram showing a roll shift state of an odd-number stand according to the present invention.
Figure 7B:
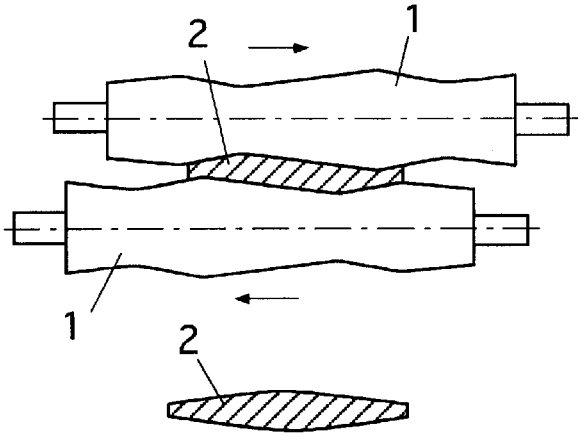
FIG. 7B is another diagram showing a roll shift state of an even-number stand according to the present invention.

Although the direction of the convex crown of the upper work roll 1 of the odd-number stand and that of the even-number stand are the same in the example of FIG. 6, as shown in the example of FIG. 7, the directions of the convex crowns of the upper work rolls 1 may be opposite. In this case, by shifting the rolling mills on the upper and down stream sides in the same direction by the same distance, effects similar to those of FIG. 6 can be obtained.

That is, the hot tandem rolling mill of the present invention has excellent effects such that both of the schedule-free rolling operation by the dispersion of the wear of the surface of the roll and the control of the cross section shape of a steel plate can be performed.

Although the invention has been described with reference to certain preferred to the embodiments. On the contrary, the invention includes all improvements, modifications, and equivalents within the scope of the appended claims.

What is claimed is:

1. A hot tandem rolling mill for shaping a plate to a predetermined cross-sectional shape, comprising:

a first roll-shift rolling mill including upper and lower work rolls, each of the work rolls having a crown with a direction;

a second roll-shift rolling mill including upper and lower work rolls, each of the work rolls having a crown with a direction;

a controller operably connected to the first and second roll-shift rolling mills to shift the first and second roll-shift rolling mills in tandem by a first crown control shift amount sufficient to impart a desired cross-sectional shape to a plate rolled between the upper and lower work rolls, and to shift the first and second roll shift-rolling mills in tandem by a second wear dispersion amount, whereby an effect on the cross-sectional shape of the plate due to the second amount shift of the first roll shift rolling mill is cancelled out by an effect on the cross-sectional shape of the plate due to the second amount shift of the second roll shift rolling mill, and whereby the second amount shift disperses wear on the upper and lower work rolls.

2. A hot tandem rolling mill according to claim 1, wherein the direction of the crown of the upper work roll of the first roll-shift rolling mill is equal to the direction of the crown of the upper work roll of the second roll-shift rolling mill, and a direction of the second amount shift of the first roll-shift rolling mill is opposite to a direction of the second amount shift of the second roll-shift rolling mill.

3. A hot tandem rolling mill according to claim 1, wherein the direction of the crown of the upper work roll of the first roll-shift rolling mill is opposite to the direction of the crown of the upper work roll of the second roll-shift rolling mill, and a direction of the second amount shift of the first roll-shift rolling mill is equal to a direction of the second amount shift of the second roll-shift rolling mill.

4. A hot tandem rolling mill according to claim 1, further comprising at least one additional pair of first and second roll-shift rolling mills.

5. A hot tandem rolling mill according to claim 2, wherein the controller periodically reverses direction of the second amount shift of the first and second roll-shift rolling mills so that the direction of the second amount shift of the first roll-shift rolling mill remains opposite to a direction of the second amount shift of the first roll-shift rolling mill.

6. A hot tandem rolling mill according to claim 3, wherein the controller periodically reverses direction of the second amount shift of the first and second roll-shift rolling mills so that the direction of the second amount shift of the first roll-shift rolling mill remains equal to a direction of the second amount shift of the first roll-shift rolling mill.

* * * * *